US009454175B2

(12) United States Patent
Ozaki

(10) Patent No.: US 9,454,175 B2
(45) Date of Patent: Sep. 27, 2016

(54) CONTROL LEVER COMPRISING SWITCH AND REMOTE-CONTROL DEVICE COMPRISING THE CONTROL LEVER

(71) Applicant: NHK SPRING CO., LTD., Yokohama-shi, Kanagawa (JP)

(72) Inventor: Taishi Ozaki, Yokohama (JP)

(73) Assignee: NHK SPRING CO., LTD., Yokohama-Shi, Kanagawa (JP)

( * ) Notice: Subject to any disclaimer, the term of this patent is extended or adjusted under 35 U.S.C. 154(b) by 0 days.

(21) Appl. No.: 14/634,616

(22) Filed: Feb. 27, 2015

(65) Prior Publication Data

US 2015/0253802 A1 Sep. 10, 2015

(30) Foreign Application Priority Data

Mar. 4, 2014 (JP) ..... 2014-041680

(51) Int. Cl.

| | |
|---|---|
| ***G05G 1/04*** | (2006.01) |
| ***G05G 1/06*** | (2006.01) |
| ***B63H 21/21*** | (2006.01) |

(52) U.S. Cl.

CPC ..... *G05G 1/06* (2013.01); *B63H 21/213* (2013.01); *G05G 1/04* (2013.01); *Y10T 74/20612* (2015.01)

(58) Field of Classification Search

CPC .... B63H 21/22; B63H 21/21; B63H 21/213; F02B 61/045; F02B 61/04; G05G 1/06; G05G 1/04; Y10T 74/20612; Y10T 74/20624; Y10T 74/20232

See application file for complete search history.

(56) References Cited

U.S. PATENT DOCUMENTS

2006/0005660 A1* 1/2006 Rick ..... B63H 21/213 74/523

FOREIGN PATENT DOCUMENTS

JP 07000478 B2 1/1995

* cited by examiner

*Primary Examiner* — Thomas Diaz

(74) *Attorney, Agent, or Firm* — Holtz, Holtz & Volek PC

(57) ABSTRACT

According to one embodiment, a control lever comprises a lever body and a grip. The lever body comprises a base and an arm. The grip is attached to the arm so as to be extractable, and comprises a handle positioned on the opposite side of the base. A switch is provided at the end of the handle. The arm is configured to allow the grip to be attached from a right side or a left side of the arm so as to be selectively extractable. A cable of the switch has a length enough to extract the grip from the arm, and is guided from between the arm and the grip to the control box through the base. The base comprises a storage portion in which a middle portion of the cable is stored.

10 Claims, 15 Drawing Sheets

CONTROL LEVER COMPRISING SWITCH AND REMOTE-CONTROL DEVICE COMPRISING THE CONTROL LEVER

CROSS-REFERENCE TO RELATED APPLICATIONS

This application is based upon and claims the benefit of priority from prior Japanese Patent Application No. 2014-041680, filed Mar. 4, 2014, the entire contents of which are incorporated herein by reference.

BACKGROUND OF THE INVENTION

1. Field of the Invention

Embodiments described herein relate generally to a control lever used by being selectively attached to a right side surface or a left side surface of a control box. The embodiments further relate to a remote-control device comprising the control lever.

2. Description of the Related Art

In a boat equipped with an outboard motor, for example, a remote-control device to control the outboard motor is provided in a cockpit. The remote-control device comprises a control box electrically and mechanically connected to the outboard motor, and a control lever attached to a side surface of the control box.

The control lever is an element to execute, for example, a shifting operation and a throttle operation of the outboard motor, and is manually turned by an operator in the back and forth direction of the boat. The control lever comprises a handle held by the operator at the upper end thereof. A tilt switch to tilt up or down the outboard motor is provided at the end of the handle.

In the remote-control device of this type, the control box is often mounted on the inner surface on the starboard side of the cockpit on the assumption that the operator operates the control lever with the right hand. Since a mounting surface of the control box is positioned on the opposite side of the control lever, if the control box is mounted on the inner surface on the starboard side of the cockpit, the control lever is attached to the left side surface of the control box. Therefore, the tilt switch is provided at the left end of the handle such that the operator can control the switch with the thumb of the right hand holding the handle.

In contrast, in a boat where the control console is provided, for example, at the center of the cockpit, the remote-control device may be mounted on the right side surface of the control console. If the control box is mounted on the right side surface of the control console, the control lever is attached to the right side surface of the control box. Therefore, the orientation of the control lever with respect to the control box is laterally inverted in comparison with the case where the control lever is attached to the left side surface of the control box.

As a result, the orientation of the handle is also laterally inverted along with the control lever, and the tilt switch is positioned at the right end of the handle. Therefore, the tilt switch is positioned on the side of the little finger of the right hand holding the handle, which impairs operability of the tilt switch.

As a measure against this, for example, the control lever is formed in a symmetrical shape in a lever mechanism disclosed in Jpn. Pat. Appin. KOKOKU Publication No. 7-478. Furthermore, a cover comprising a grip can be attached from either the right side or the left side of the control lever.

According to the technology disclosed in the above publication, for example, even if the control lever is detached from the right side surface of the control box and attached to the left side surface, the orientation of the grip can be constantly maintained by laterally inverting the mounting orientation of the cover with respect to the control lever.

As a result, the tilt switch provided at the end of the grip can be constantly positioned on the side of the thumb of the right hand holding the grip.

Therefore, operability of the tilt switch can be preferably maintained even if the orientation of the control lever is laterally inverted.

In the control lever disclosed in the above publication, a cord is extended from the tilt switch. The cord is guided below the control lever through an opening opened at the middle portion of the control lever, and is routed from below the control lever to the control box.

When the cover is laterally inverted and incorporated into the control lever in such a structure, the cover is first detached from the control lever and then the tilt switch is detached from the grip of the cover. Following this, the detached tilt switch is moved from the opening to the opposite side of the control lever and fitted into the grip again. After this, a series of operations such as attaching the cover to the control lever in the laterally inverted orientation is required.

As a result, when the cover is inverted, troublesome operations such as detaching the tilt switch, attaching the tilt switch and changing the wiring path of the cord are unavoidable. Therefore, there is plenty of scope for improvement in view of workability.

BRIEF SUMMARY OF THE INVENTION

A first object of the present invention is to acquire a control lever having excellent workability during the inversion of the grip, where the switch can be positioned on the side of the thumb of the hand holding the handle even if the orientation of the control lever with respect to the control box is laterally inverted, and furthermore, the grip can be laterally inverted with the switch attached to the grip.

A second object of the present invention is to acquire a remote-control device comprising the above-described control lever.

To achieve the first object of the present invention, a control lever of one of the embodiments is attached to any one of a right side surface and a left side surface of a control box so as to be selectively detachable, and manually turned in the back and forth direction of the control box. The control lever comprises a lever body and a grip.

The lever body comprises a base connected to a rotatable member in the control box, and an arm integrally extended from the base. The grip comprises a handle attached to the arm of the lever body so as to be extractable in the longitudinal direction of the arm. The handle is positioned on the opposite side of the base. A switch manually controlled is provided at the end of the handle.

The arm of the lever body is configured to allow the grip to be attached from either a right side or a left side of the arm so as to be selectively extractable. A cable extended from the switch has a length enough to extract the grip from the arm, and is guided from between the arm and the grip to the control box through the base. The base comprises a storage portion in which a middle portion of the cable is stored so as to be paid out.

According to a preferable embodiment, the storage portion comprises a serpentine-curved path, and the middle portion of the cable passes through the path.

According to another preferable embodiment, the cable has a length at least two times as long as a whole length of the arm.

According to another preferable embodiment, the control lever further comprises a lock lever which locks the lever body in a neutral position. The lock lever is attached to the arm of the lever body from the right side or the left side of the arm so as to be selectively detachable.

According to yet another preferable embodiment, the arm of the lever body comprises a pair of opposite walls facing each other with an interval, a connecting wall extended between the opposite walls, a first groove defined by one surface of the connecting wall and inner surfaces of the opposite walls, and a second groove defined by the other surface of the connecting wall and the inner surfaces of the opposite walls. The grip is attached to the arm so as to cover any one of the first groove and the second groove and to be extractable in the longitudinal direction of the arm. The lock lever is fitted into the other one of the first groove and the second groove so as to be selectively detachable.

According to yet another preferable embodiment, the arm comprises a wiring groove through which the cable passes. The wiring groove is extended along the longitudinal direction of the arm in a position displaced from the first groove and the second groove. One end of the wiring groove is opened at a distal end of the arm. The other end of the wiring groove is continuously connected to the storage portion.

According to yet another preferable embodiment, the control lever further comprises a cover which covers the storage portion. The cover is attached to the base of the lever body so as to be detachable.

To achieve the second object, a remote-control device of one of the embodiments comprises a control box comprising a right side surface and a left side surface, and a control lever attached to any one of the right side surface and the left side surface of the control box so as to be selectively detachable, and manually turned in the back and forth direction of the control box. The control lever has the above-described structure to achieve the first object.

According to a preferable embodiment, the control lever comprises a lock lever which locks the lever body in a neutral position. The lock lever is attached to the arm of the lever body from the right side or the left side of the arm so as to be selectively detachable.

According to the present invention, when the control lever is detached from the right side surface of the control box and attached to the left side surface, or detached from the left side surface and attached to the right side surface, the grip is first extracted from the arm of the lever body. Next, the grip is laterally inverted and attached to the arm along with the switch and the cable. The orientation of the handle of the grip can thereby be constantly maintained even if the orientation of the control lever with respect to the control box is laterally inverted. Therefore, the switch can be always positioned on the side of the thumb of the hand holding the handle.

Furthermore, if the grip is extracted from the arm of the lever body, the cable is paid out from the storage portion of the base following the extraction. Thus, whenever the grip is extracted from the arm of the lever body, it is unnecessary to detach the switch from the grip or change the wiring path of the cable. Therefore, the grip can be laterally inverted while the switch from which the cable is extended is attached to the grip.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments will be described hereinafter with reference to FIG. 1 to FIG. 16 where the embodiments are applied to a boat.

Figure 1:
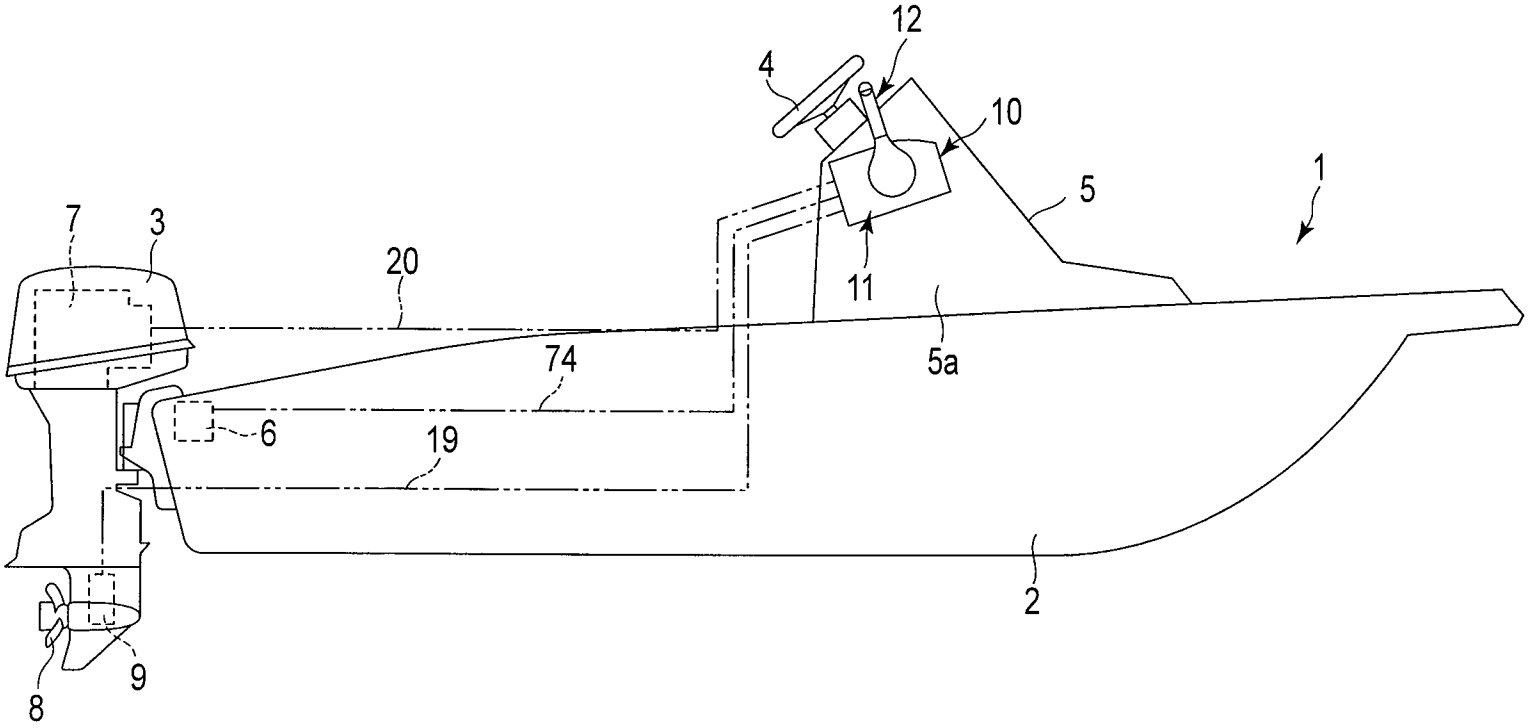
FIG. 1 is a side view of a boat comprising a remote-control device of an embodiment.

FIG. 1 shows an example of a boat 1. The boat 1 comprises a hull 2 and an outboard motor 3 attached to the stern of the hull 2. A control console 5 comprising a wheel 4 is provided in the center of the hull 2. The outboard motor 3 can be moved between a tilt down position and a tilt up position by an actuator 6. The outboard motor 3 comprises a propeller 8 driven by an engine 7. A shift mechanism 9 is provided in a driveline for transmitting power of the engine 7 to the propeller 8. The shift mechanism 9 rotates the propeller 8 in the normal direction to cause the boat 1 to go ahead, and rotates the propeller 8 backwards to cause the boat 1 to go astern.

As shown in FIG. 1, the control console 5 comprises a remote-control device 10. The remote-control device 10 is an element which controls the shift mechanism 9 of the outboard motor 3 and a fuel supply system of the engine 7. The remote-control device 10 of the present embodiment is mounted on a right side surface 5*a* of the control console 5 on the assumption that the operator operates remote-control device 10 with the right hand. The right side surface 5*a* is positioned on the starboard side of the hull 2.

Figure 2:
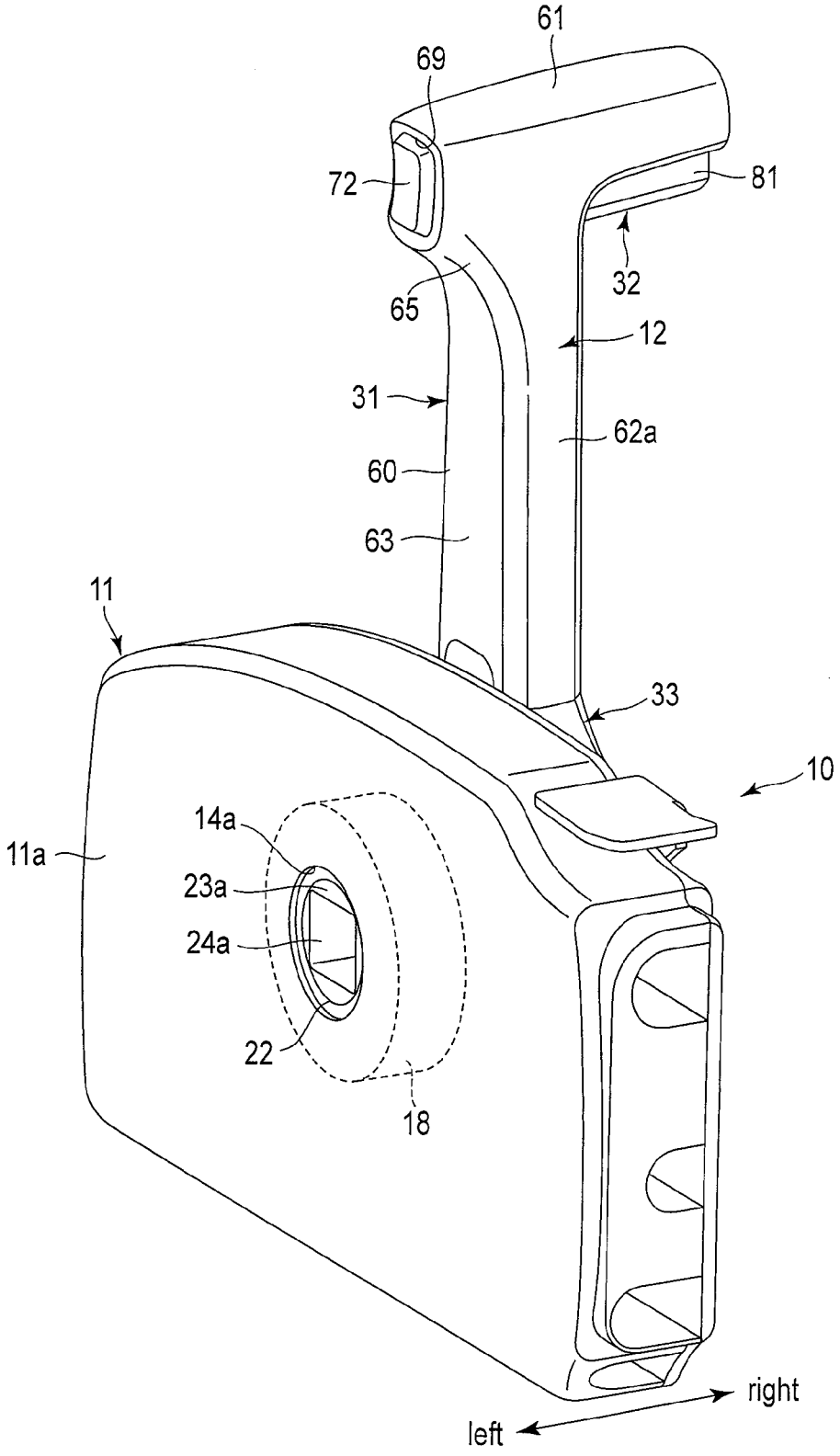
FIG. 2 is a perspective view of the remote-control device where a control lever is attached to a right side surface of a control box.
Figure 3:
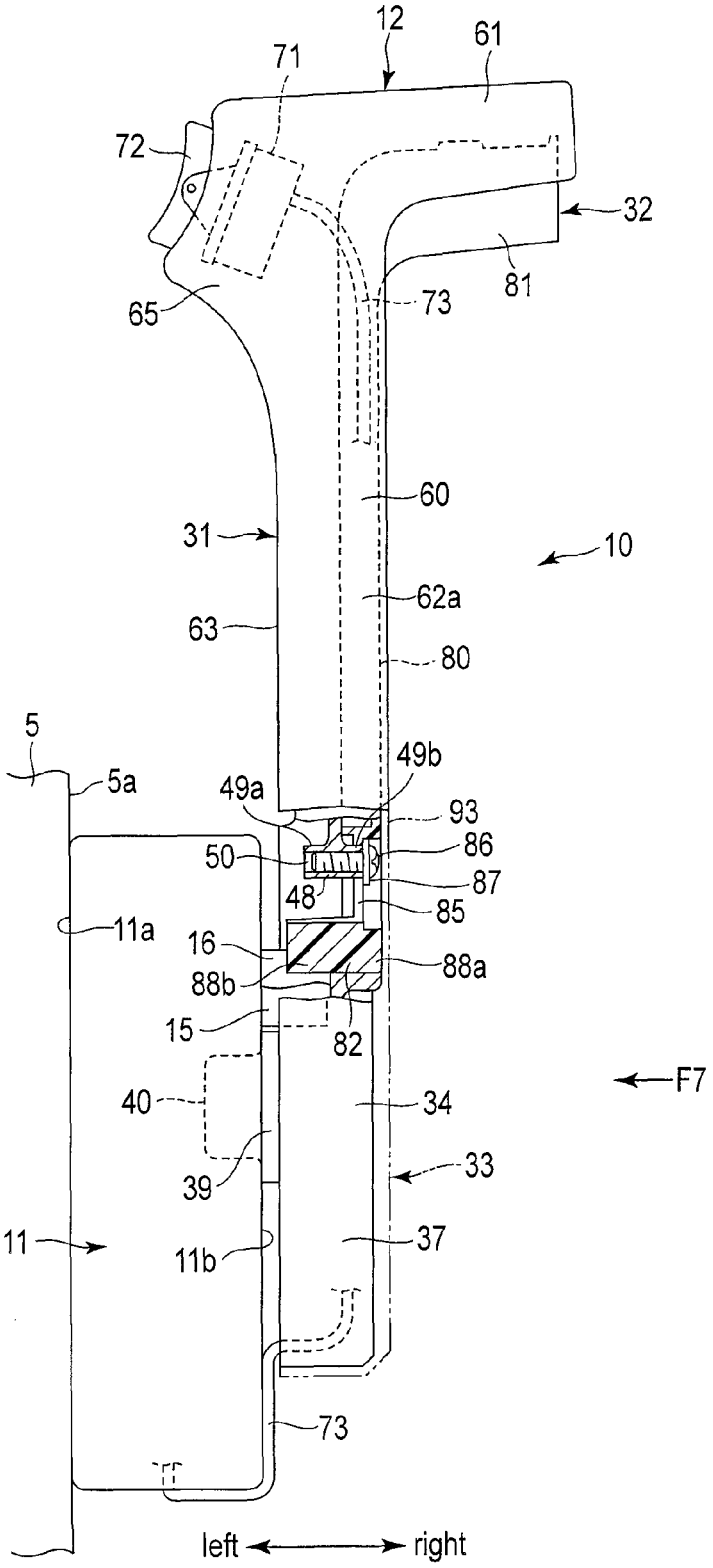
FIG. 3 is a cross-sectional view of a part of the remote-control device shown in FIG. 2.
Figure 4:
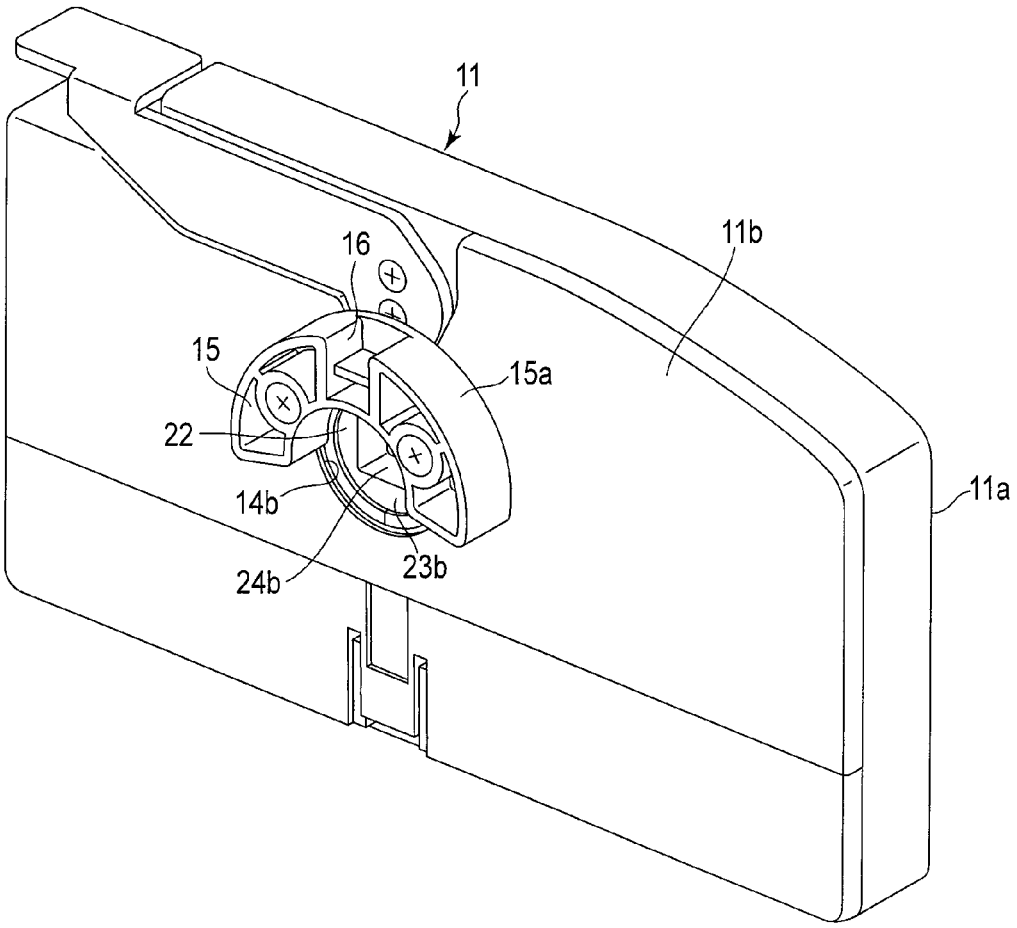
FIG. 4 is a perspective view of the control box of the remote-control device shown in FIG. 2.

FIG. 2 to FIG. 4 show an appearance of the remote-control device 10. The remote-control device 10 comprises a control box 11 and a control lever 12. The control box 11 has a flat shape comprising a left side surface 11*a* and a right side surface 11*b*. Circular openings 14*a* and 14*b* are formed at the center of the left side surface 11*a* and the center of the right side surface 11*b* of the control box 11, respectively. In the present embodiment, the left side surface 11*a* of the control box 11 is fixed to the right side surface 5*a* of the control console 5.

As shown in FIG. 3 and FIG. 4, a neutral lock holder 15 is attached to the control box 11. The neutral lock holder 15 is an element which can be selectively attached to and detached from either the left side surface 11*a* or the right side surface 11*b* of the control box 11. In the present embodiment, the neutral lock holder 15 is fixed to the right side surface 11*b* of the control box 11.

The neutral lock holder 15 has a shape encircling the upper half of the openings 14*a* and 14*b* of the control box 11. More specifically, the neutral lock holder 15 comprises an external surface 15*a*. The external surface 15*a* forms an arc concentric with the openings 14*a* and 14*b*, and protrudes from the right side surface 11*b* of the control box 11 to the side of the control box 11. A recess 16 is formed at the top of the external surface 15*a* of the neutral lock holder 15.

As shown in FIG. 2, a rotatable member 18 is accommodated in the control box 11. The rotatable member 18 is connected to the shift mechanism 9 of the outboard motor 3 via a shift cable 19 shown in FIG. 1. The rotatable member 18 is further connected to the fuel supply system of the engine 7 via a throttle cable 20 shown in FIG. 1.

The rotatable member 18 comprises a boss 22 at the center thereof. The boss 22 comprises a first end face 23*a* and a second end face 23*b*. As shown in FIG. 2, the first end face 23*a* is positioned on the side of the left side surface 11*a* of the control box 11. A square fitting hole 24*a* is formed in the first end face 23*a*. The fitting hole 24*a* is exposed outside the control box 11 from the opening 14*a*.

As shown in FIG. 4, the second end face 23*b* of the boss 22 is positioned on the side of the right side surface 11*b* of the control box 11. A square fitting hole 24*b* is formed in the second end face 23*b*. The fitting hole 24*b* is exposed outside the control box 11 from the opening 14*b*.

The control lever 12 is an element which rotates the rotatable member 18, and is attached to the right side surface 11*b* of the control box 11. The control lever 12 of the present embodiment is manually controlled by the operator between a neutral position perpendicular to the control box 11, a first control position moved from the neutral position to the front of the control box 11, and a second control position moved from the neutral position to the back of the control box 11.

The first control position comprises a shift area for switching the shift mechanism 9 to a direction where the boat 1 goes ahead with the engine 7 at idle, and a throttle area for opening and closing a throttle of the fuel supply system while keeping the shift mechanism 9 in the direction where the boat 1 goes ahead.

Similarly, the second control position comprises a shift area for switching the shift mechanism 9 to a direction where the boat 1 goes astern with the engine 7 at idle, and a throttle area for opening and closing the throttle of the fuel supply system while keeping the shift mechanism 9 in the direction where the boat 1 goes astern.

Figure 5:
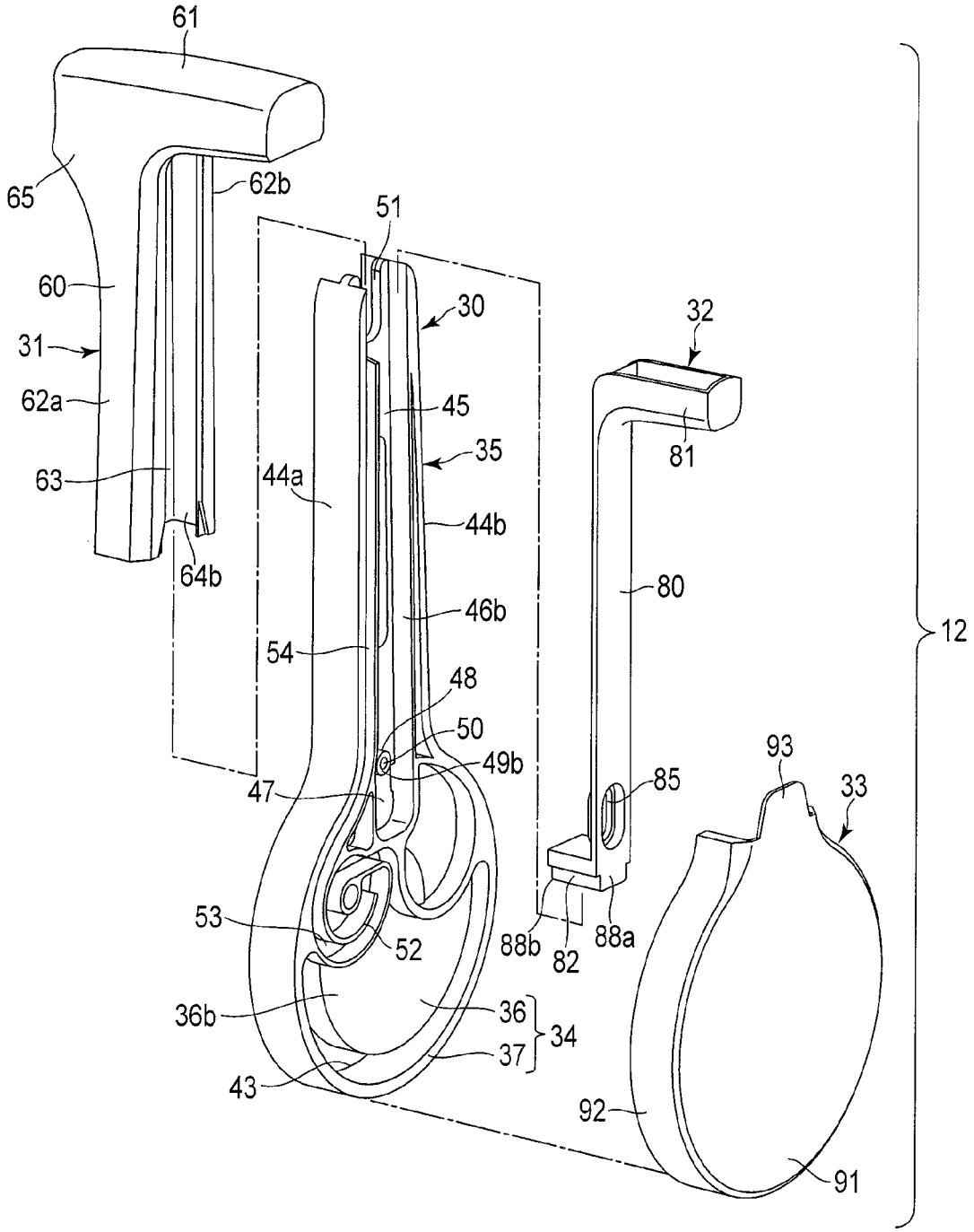
FIG. 5 is an exploded view of the control lever of the embodiment.

As shown in FIG. 5, the control lever 12 comprises a lever body 30, a grip 31, a lock lever 32 and a cover 33.

Figure 6:
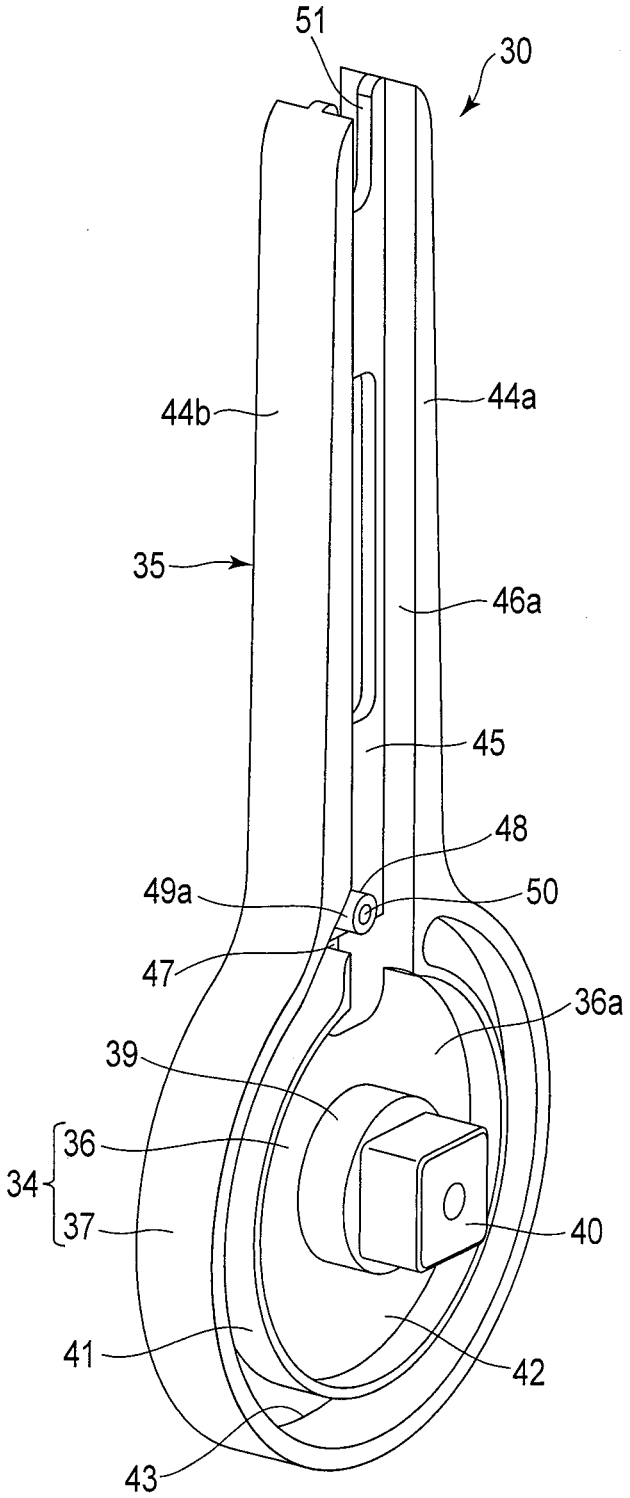
FIG. 6 is a perspective view of a lever body of the control lever of FIG. 5 seen from the opposite side.

The lever body 30 comprises a base 34 and an arm 35. As shown in FIG. 5 and FIG. 6, the base 34 comprises a disciform supporting wall 36 and an external wall 37 encircling the supporting wall 36. The supporting wall 36 comprises a first surface 36*a* and a second surface 36*b* positioned at the back of the first surface 36*a*. The external wall 37 is extended along a direction orthogonal to the supporting wall 36 and protrudes in the thickness direction of the supporting wall 36 than the first surface 36*a* and the second surface 36*b*.

FIG. 6 is a perspective view of the lever body 30 where the lever body 30 is seen from the direction of the first surface 36*a* of the base 34. As shown in FIG. 6, a cylindrical boss 39 integrally protrudes from the center of the first surface 36*a* of the supporting wall 36. The boss 39 is positioned inside the neutral lock holder 15. A prismatic fitting protrusion 40 is concentrically formed on the top surface of the boss 39. The fitting protrusion 40 is fitted into the fitting hole 24*b* of the rotatable member 18 so as to be detachable. The base 34 of the lever body 30 thereby faces the right side surface 11*b* of the control box 11.

Figure 7:
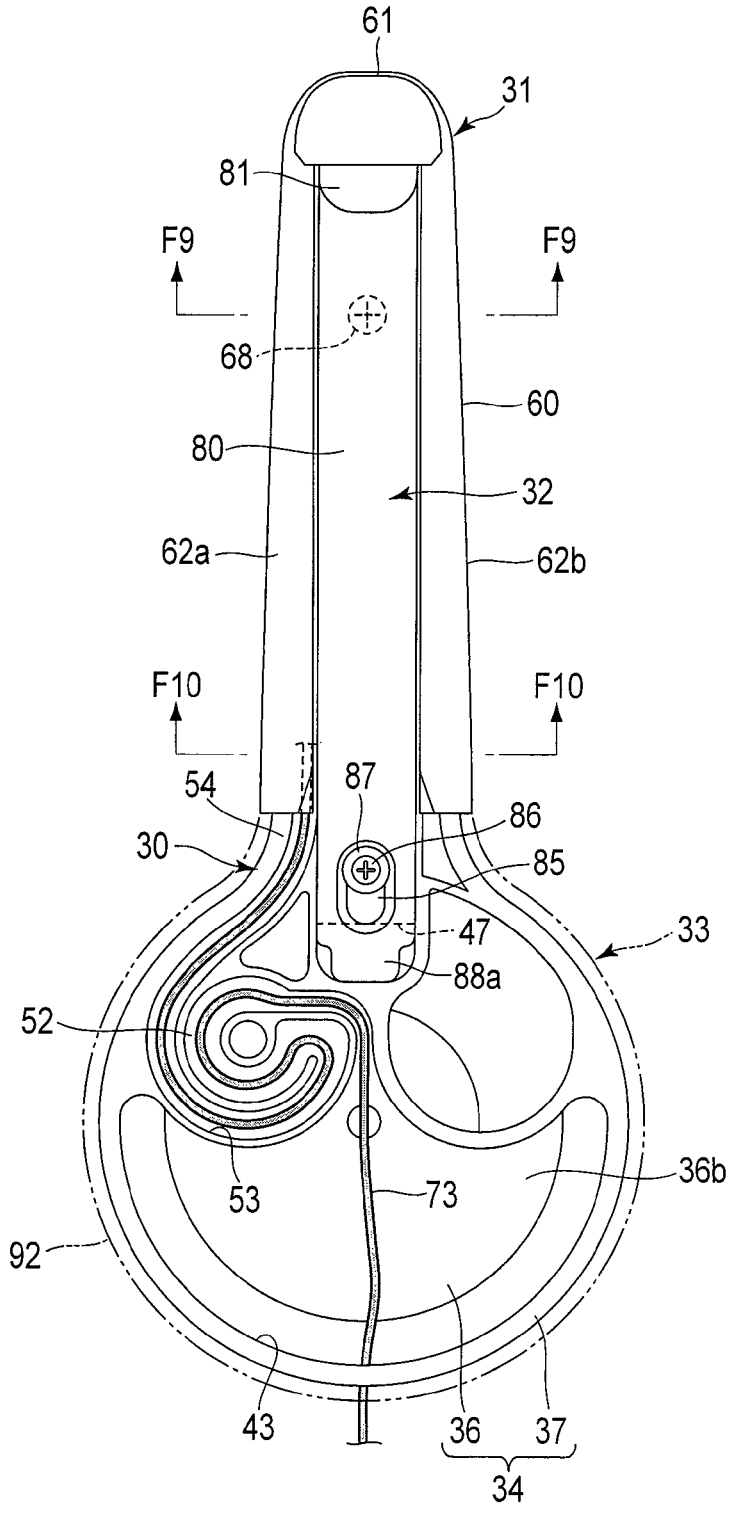
FIG. 7 is a front view of the control lever of the remote-control device seen from the direction of arrow F7 of FIG. 3.

A guide wall 41 is formed around the first surface 36*a* of the base 34. The guide wall 41 concentrically encircles the boss 39. A ring-shaped guide groove 42 into which the neutral lock holder 15 is slidably fitted is formed between the guide wall 41 and the boss 39. As shown in FIG. 5 to FIG. 7, a harness through-hole 43 is further formed in the supporting wall 36 of the base 34. The harness through-hole 43 is positioned between the guide wall 41 and the external wall 37, and has an opening shape curved to form an arc centered around the boss 39.

Figure 8:
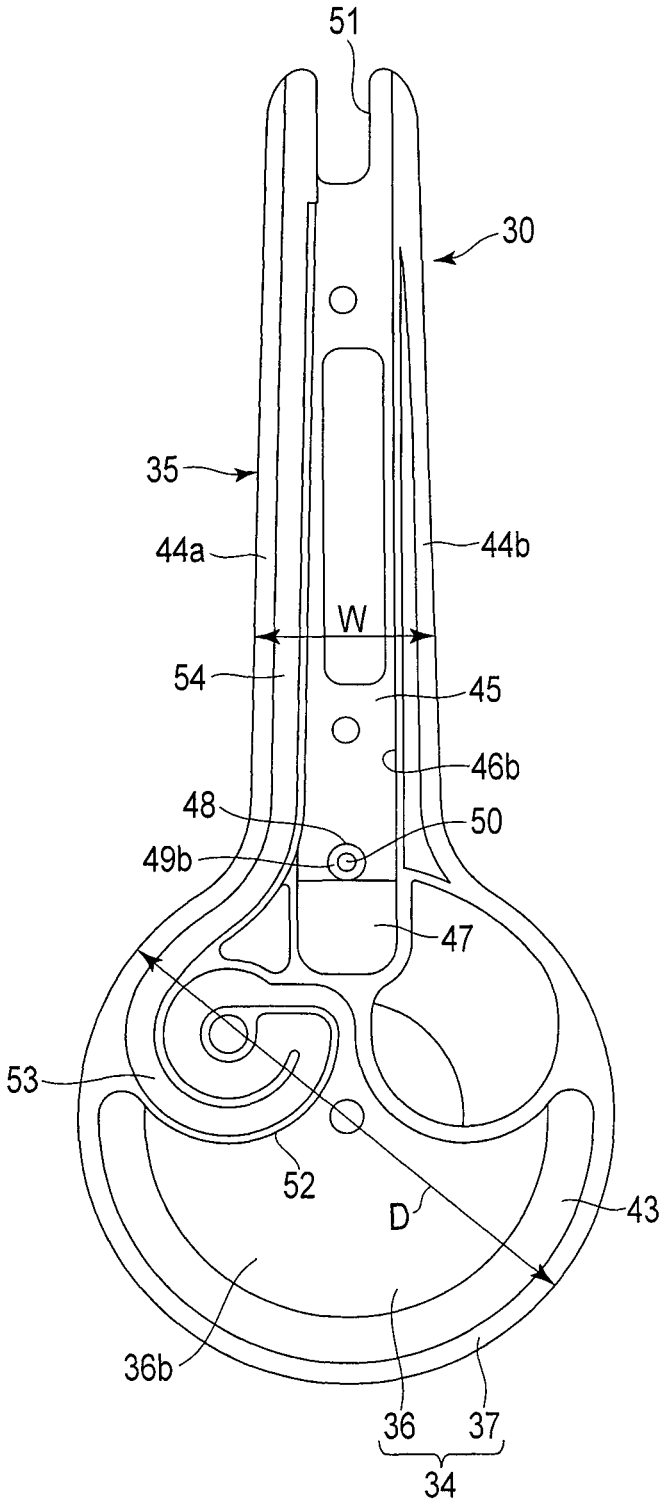
FIG. 8 is a front view of the lever body where a harness storage portion and a wiring groove to store a wire harness are formed.

As shown in FIG. 5, FIG. 6 and FIG. 8, the arm 35 of the lever body 30 is integrally extended from the base 34. More specifically, the arm 35 linearly protrudes from the outer periphery of the supporting wall 36 of the base 34 in a radial direction of the support wall 36. The width W of the arm 35 is less than the diameter D of the base 34.

Figure 9:
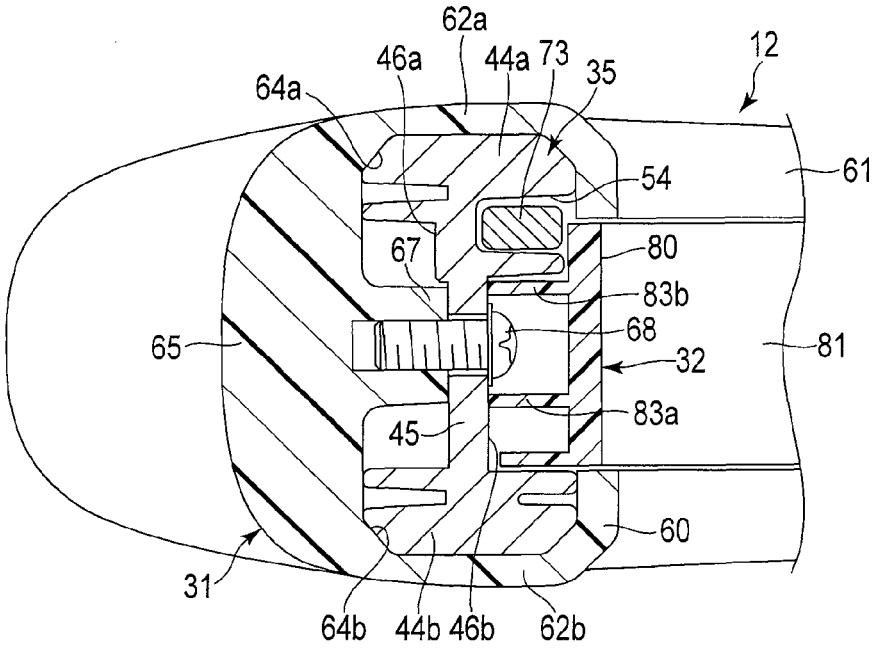
FIG. 9 is a cross-sectional view of the control lever seen along line F9-F9 of FIG. 7.
Figure 10:
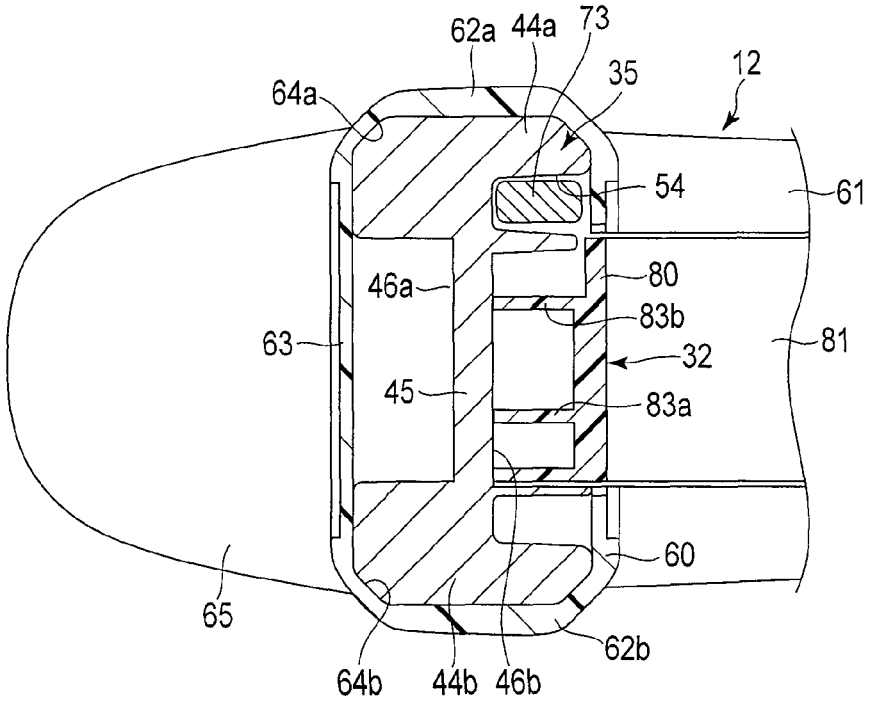
FIG. 10 is a cross-sectional view of the control lever seen along line F10-F10 of FIG. 7.

As shown in FIG. 6, FIG. 9 and FIG. 10, the arm 35 of the present embodiment is constituted by a pair of opposite walls 44*a* and 44*b* and a connecting wall 45. The opposite walls 44*a* and 44*b* face each other in the width direction of the arm 35 with an interval. The proximal ends of the opposite walls 44*a* and 44*b* integrally continue to the external wall 37 of the base 34 while forming a smooth arc. The connecting wall 45 is extended between the opposite walls 44*a* and 44*b* to connect the opposite walls 44*a* and 44*b* to each other. Accordingly, the arm 35 of the present embodiment has an H-shaped cross section.

The arm 35 comprises a first groove 46*a* and a second groove 46*b*. The first groove 46*a* is defined by one surface of the connecting wall 45 and the inner surfaces of the opposite walls 44*a* and 44*b*. The first groove 46*a* is positioned on the side of the first surface 36*a* of the base 34. The second groove 46*b* is defined by the other surface of the connecting wall 45 and the inner surfaces of the opposite walls 44*a* and 44*b*. The second groove 46*b* is positioned on the side of the second surface 36*b* of the base 34.

The first groove 46*a* and the second groove 46*b* are extended straight in the longitudinal direction of the arm 35, and arranged in the lateral direction of the control lever 12 to sandwich the connecting wall 45. Furthermore, a shape of the first groove 46*a* and a shape of the second groove 46*b* are symmetrical to each other. Therefore, the arm 35 is formed to have a symmetrical shape.

As shown most clearly in FIG. 3 and FIG. 8, a square through-hole 47 is formed between the proximal end of the connecting wall 45 of the arm 35 and the supporting wall 36 of the base 34. The through-hole 47 is opened on the first groove 46*a* and the second groove 46*b*. The through-hole 47 coincides with the recess 16 of the neutral lock holder 15 when the control lever 12 is moved to the neutral position.

A columnar boss 48 is formed at the proximal end of the connecting wall 45 adjacent to the through-hole 47. The boss 48 comprises a first end 49*a*, a second end 49*b* and a screw hole 50. The first end 49*a* is positioned on the first groove 46*a*. The second end 49*b* is positioned on the second groove 46*b*. The screw hole 50 is opened on the top surface of the first end 49*a* and the top surface of the second end 49*b*.

The connecting wall 45 of the arm 35 further comprises a distal end positioned on the opposite side of the base 34. A notch 51 is formed at the distal end of the connecting wall 45. The notch 51 is cut out to be recessed from the distal end toward the proximal end of the connecting wall 45.

As shown in FIG. 5 and FIG. 8, a harness storage portion 52 is provided in the base 34 of the lever body 30. The harness storage portion 52 is positioned above the second surface 36*b* of the supporting wall 36, and is closer to the side of the opposite wall 44*a* than the center of the supporting wall 36. The harness storage portion 52 of the present embodiment comprises a serpentine-curved path 53. One end of the path 53 is extended toward the proximal end of the opposite wall 44*a*. The other end of the path 53 is opened above the second surface 36*b* of the supporting wall 36.

As shown in FIG. 5 and FIG. 8, the arm 35 of the lever body 30 comprises a wiring groove 54. The wiring groove 54 is linearly extended along the longitudinal direction of the arm 35. One end of the wiring groove 54 is opened in the notch 51 of the distal end of the arm 35. The other end of the wiring groove 54 is connected to the one end of the path 53 constituting the harness storage portion 52. In the present embodiment, the wiring groove 54 is formed in one side edge of the opposite wall 44*a*. Therefore, the wiring groove 54 is displaced from the first groove 46*a* and the second groove 46*b*.

As shown in FIG. 3 and FIG. 5, the grip 31 of the control lever 12 comprises a grip body 60 and a handle 61. The grip body 60 is attached from the left side or the right side of the lever body 30 to the arm 35 of the lever body 30 so as to be extractable from the arm 35.

More specifically, as shown in FIG. 5, FIG. 9 and FIG. 10, the grip body 60 comprises a pair of external walls 62*a* and 62*b* and a sidewall 63. The external walls 62*a* and 62*b* face each other with an interval to cover the opposite walls 44*a* and 44*b* of the arm 35 from the outside. In the present embodiment, guide grooves 64*a* and 64*b* to which the opposite walls 44*a* and 44*b* are slidably fitted are formed on the inner surfaces of the external walls 62*a* and 62*b*.

The external walls 62*a* and 62*b* of the grip body 60 overlap one side edge and the other side edge of the opposite wall 44*a* and one side edge and the other side edge of the opposite wall 44*b*, respectively, and continuously cover these side edges along the whole length of the opposite walls 44*a* and 44*b*. In addition, the edge of the external wall 62*a* protrudes on the wiring groove 54 to cover at least a part of the wiring groove 54.

The sidewall 63 of the grip body 60 is extended between the edges of the external walls 62*a* and 62*b* to connect the external walls 62*a* and 62*b* to each other. When the control lever 12 is attached to the right side surface 11*b* of the control box 11 as shown in FIG. 2 and FIG. 3, the sidewall 63 of the grip body 60 covers the first groove 46*a* from the left side of the lever body 30.

As shown in FIG. 3 and FIG. 5, the handle 61 is integrally formed at the distal end of the grip body 60. The handle 61 is an element held by the operator with, for example, the right hand, and is horizontally extended in the lateral direction of the control lever 12 so as to be orthogonal to the grip body 60. The handle 61 is formed in a hollow pipe shape opened to the base 34 of the lever body 30. A switch supporting portion 65 is integrally formed at the left end of the handle 61. The switch supporting portion 65 protrudes on the left side of the grip body 60 beyond the sidewall 63 of the grip body 60.

As shown in FIG. 9, a screw receiving portion 67 is integrally formed on the inner surface of the switch supporting portion 65. The screw receiving portion 67 protrudes from the inner surface of the switch supporting portion 65 to the connecting wall 45 of the arm 35. A screw 68 serving as a fixing component penetrates the connecting wall 45 and is driven into the screw receiving portion 67. The grip 31 is thus attached to the arm 35 of the lever body 30 by the screw 68. When the grip 31 is attached to the arm 35, the distal end of the arm 35 comprising the notch 51 is positioned inside the switch supporting portion 65.

As shown in FIG. 2, the grip 31 comprises a switch mounting hole 69. The switch mounting hole 69 is opened on the left end surface of the switch supporting portion 65. The tilt switch 71, which is an example of a switch, is fitted into the switch mounting hole 69. The tilt switch 71 is an element which controls the actuator 6 to tilt up or down the outboard motor 3, and comprises a control button 72 and a wire harness 73.

The control button 72 is exposed from the switch mounting hole 69 so as to be controlled by the operator with the right hand grasping the handle 61. The wire harness 73 is an example of a cable, and is extended from the tilt switch 71. The wire harness 73 has a length enough to extract the grip body 60 from the arm 35 of the lever body 30. According to the present embodiment, the wire harness 73 has a length, for example, at least two times as long as the whole length of the arm 35.

Figure 11:
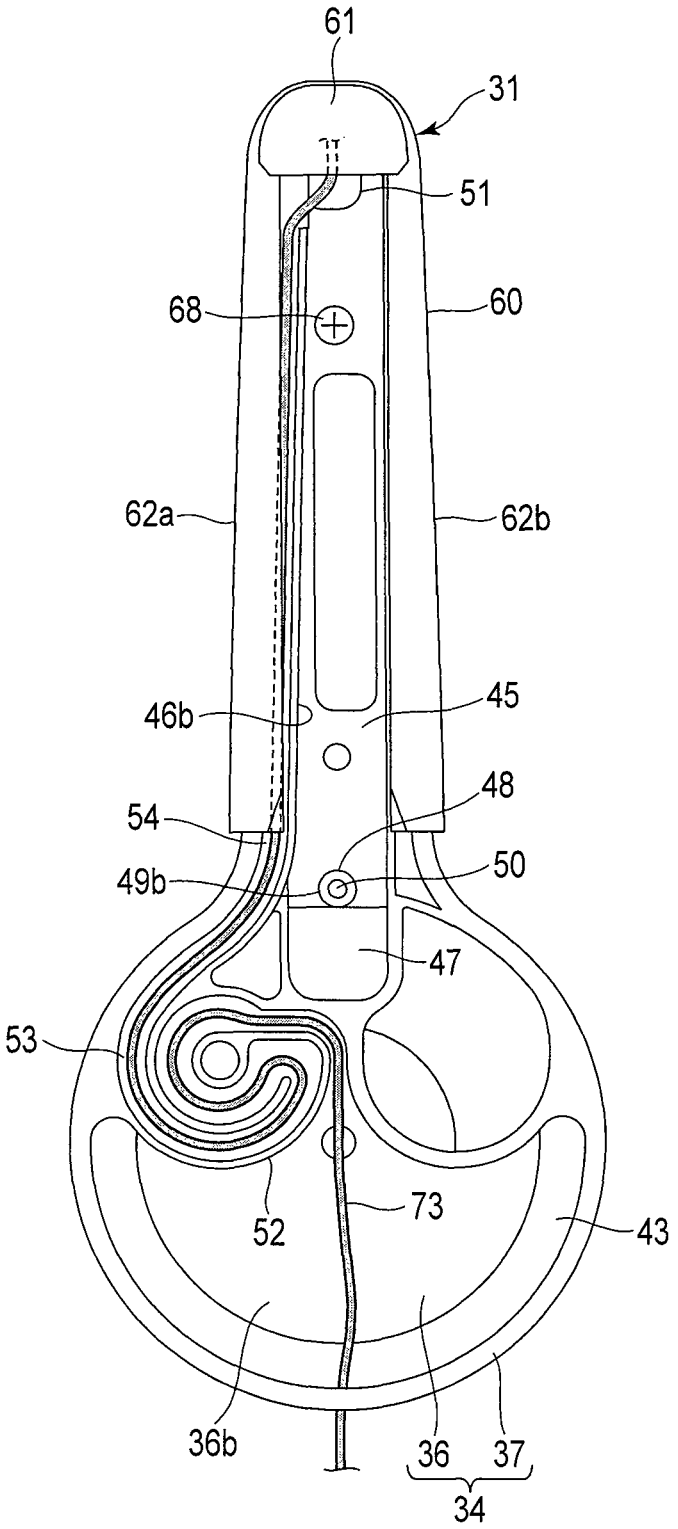
FIG. 11 is a front view of the control lever where a lock lever is detached from the lever body.

As shown in FIG. 11, the wire harness 73 is routed from the inside of the switch supporting portion 65 to the wiring groove 54 through the notch 51. Furthermore, the wire harness 73 is guided above the first surface 36*b* of the base 34 from the wiring groove 54 through the path 53 of the harness storage portion 52, and then pulled out to the outside of the control lever 12 through the harness through-hole 43.

That is, the wire harness 73 has a middle portion which passes above the base 34 of the lever body 30, and the middle portion of the wire harness 73 passes along the path 53 of the harness storage portion 52. Therefore, the middle portion of the wire harness 73 is stored in the harness storage portion 52 in the serpentine-curved form so as to be paid out. Therefore, the length of the wire harness 73 is sufficiently secured inside the control lever 12.

The pulled-out end of the wire harness 73 is routed inside the control box 11, and then connected to the actuator 6 via a relay wire harness 74 shown in FIG. 1.

The lock lever 32 is an element to lock the control lever 12 in the neutral position. As shown in FIG. 5, the lock lever 32 comprises a slide 80, a gripping portion 81 and an engagement portion 82. The slide 80 is extended straight in the longitudinal direction of the arm 35. The gripping portion 81 is provided at one end of the slide 80 along the longitudinal direction. The engagement portion 82 is provided at the other end of the slide 80 along the longitudinal direction.

As shown in FIG. 9 and FIG. 10, the slide 80 has a shape slidably fitted into either the first groove 46*a* or the second groove 46*b* of the lever body 30. In the present embodiment, the slide 80 is fitted to the second groove 46*b* and is extended between the other side ends of the external walls 62*a* and 62*b* of the grip body 60.

One side end of the slide 80 protrudes on a part of the wiring groove 54 to cover the wire harness 73 routed along the wiring groove 54. The slide 80 further comprises ribs 83*a* and 83*b* positioned inside the second groove 46*b*. The ends of the ribs 83*a* and 83*b* are slidably in contact with the connecting wall 45, which is the bottom of the second groove 46*b*, to support the slide 80.

As shown in FIG. 5 and FIG. 7, a guide hole 85 is formed at the other end of the slide 80. The guide hole 85 is a hole elongated in the slide direction of the slide 80. The second end 49*b* of the boss 48 protruding from the connecting wall 45 is slidably fitted into the guide hole 85. A flat washer 87 is fixed to the top surface of the second end 49*b* by the screw 86. The flat washer 87 is slidably in contact with the periphery of the guide hole 85 to support the slide 80 on the second groove 46*b*.

The gripping portion 81 is nearly-horizontally extended from one end of the slide 80 to the right side of the slide 80. The gripping portion 81 is fitted into the handle 61 of the grip 31, and the lower portion of the gripping portion 81 protrudes below the handle 61.

As shown in FIG. 3, the engagement portion 82 of the lock lever 32 is nearly-horizontally extended from the other end of the slide 80 to the left side of the slide 80. The engagement portion 82 penetrates the through-hole 47 of the lever body 30. The engagement portion 82 comprises a first corner 88*a* and a second corner 88*b*. The first corner 88*a* is positioned immediately below the slide 80 and at the end of the second groove 46*b*. The second corner 88*b* is positioned at the front end of the engagement portion 82 and at the end of the first groove 46*a*.

The lock lever 32 can be slid between a lock position and an unlock position. In FIG. 3, the lock lever 32 is slid to the lock position. In the lock position, the second corner 88*b* of the engagement portion 82 of the lock lever 32 is fitted into the recess 16 of the neutral lock holder 15, and the control lever 12 is locked in the neutral position. In the unlock position, the second corner 88*b* of the engagement portion 82 of the lock lever 32 is displaced from the recess 16 of the neutral lock holder 15, and the control lever 12 is unlocked.

Furthermore, in the lock position shown in FIG. 3, the gripping portion 81 protrudes below the handle 61 of the grip 31. The operator can thereby easily control the gripping portion 81 to the unlock direction with the right fingertips. The lock lever 32 is constantly pressed against the lock position by a spring (not shown).

As shown in FIG. 5 and FIG. 7, the cover 33 is attached to the base 34 of the lever body 30 so as to be detachable. The cover 33 comprises a disciform sidewall portion 91 which faces the supporting wall 36, and a peripheral wall portion 92 which covers the external wall 37 of the base 34. The harness storage portion 52 of the base 34, the middle portion of the wire harness 73 paid out from the harness storage portion 52, and the harness through-hole 43 are covered by the sidewall portion 91 of the cover 33.

As shown in FIG. 3 and FIG. 5, the cover 33 comprises a flat piece portion 93. The piece portion 93 protrudes on the slide 80 of the lock lever 32 from a part of the periphery of the sidewall portion 91, and is positioned between the other side ends of the external walls 62*a* and 62*b* of the grip body 60.

In the present embodiment, the piece portion 93 overlaps the guide hole 85 of the slide 80 when the lock lever 32 is slid to the unlock position. In other words, the piece portion 93 covers the guide hole 85. As a result, the inside of the arm 35 of the lever body 30 is not seen from the outside through the guide hole 85, which can keep a good appearance of the control lever 12. Furthermore, for example, foreign objects such as grit and dust can be prevented from entering into the second groove 46*b* from the guide hole 85.

Figure 16:
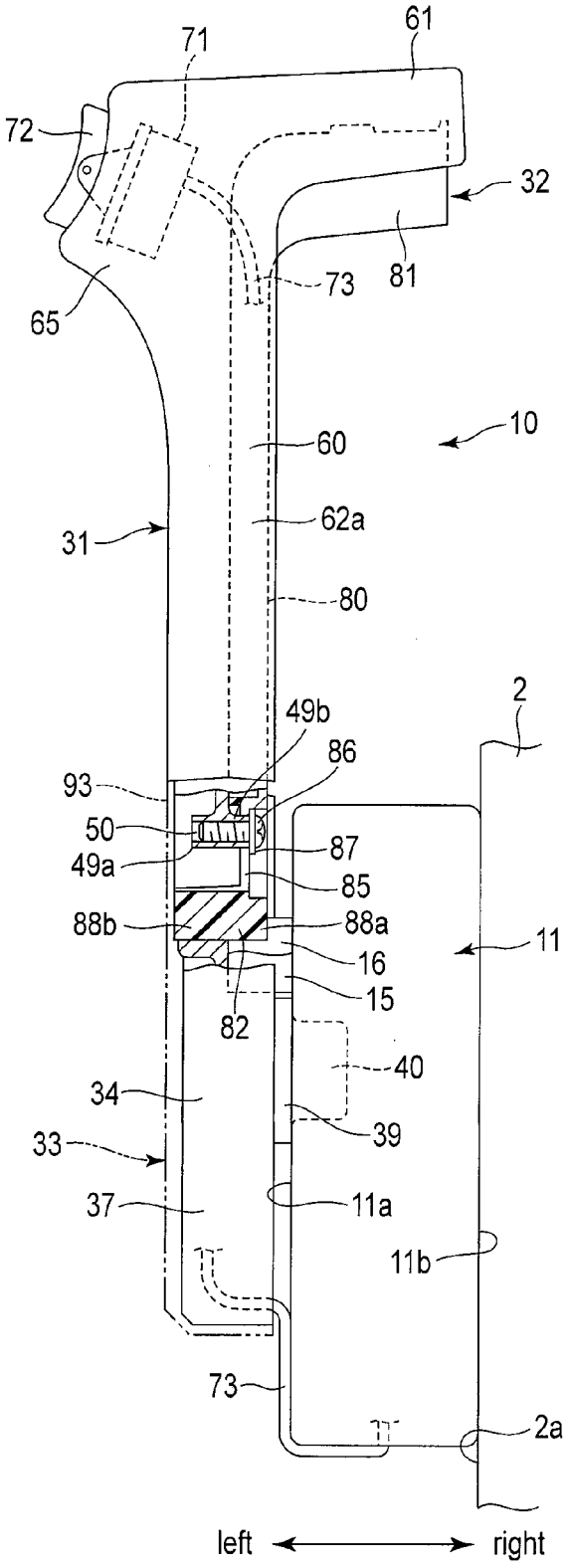
FIG. 16 is a cross-sectional view of a part of the remote-control device shown in FIG. 15.

In FIG. 16, the remote-control device 10 is detached from the right side surface 5*a* of the control console 5 and attached to an inner surface 2*a* on the starboard side of the hull 2. In this case, the right side surface 11*b* of the control box 11 is fixed to the inner surface 2*a* on the starboard side of the hull 2. Therefore, the control lever 12 and the neutral lock holder 15 are required to be detached from the right side surface 11*b* of the control box 11 and attached to the left side surface 11*a* of the control box 11.

At this time, if the control lever 12 is simply inverted laterally and attached to the left side surface 11*a* of the control box 11, the control button 72 of the tilt switch 71 is positioned on the right end of the handle 61. The operator is therefore unable to control the control button 72 with the right fingertips.

Therefore, in the present embodiment, when the control lever 12 is detached from the right side surface 11*b* of the control box 11 and attached to the left side surface 11*a*, the cover 33, the grip 31 and the lock lever 32 are detached from the lever body 30, and the detached grip 31 and the lock lever 32 are laterally inverted and then attached again to the lever body 30.

More specifically, the cover 33 is first detached from the base 34 of the lever body 30. If the cover 33 is detached, the screw 86 is exposed as shown in FIG. 7. Then, the screw 86 is loosened and the lock lever 32 is detached from the second groove 46*b* of the lever body 30. In FIG. 11, the lock lever 32 is detached from the lever body 30. If the lock lever 32 is detached, the screw 68 on the connecting wall 45 is exposed. Then, the screw 68 is loosened and the fixation of the grip 31 to the lever body 30 is released.

Figure 12:
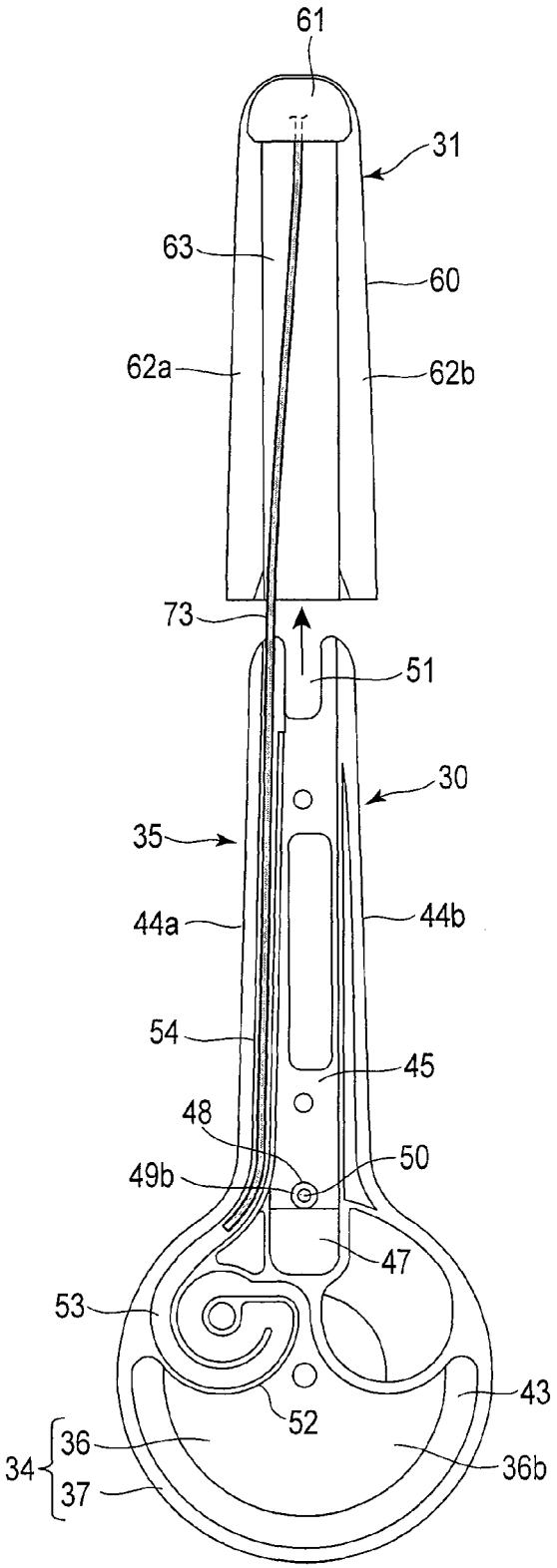
FIG. 12 is a front view of the control lever where a grip is extracted from an arm of the lever body.

After this, as shown by the arrow in FIG. 12, the grip 31 equipped with the tilt switch 71 is slid along the arm 35 of the lever body 30, and extracted from the lever body 30. If the grip 31 is extracted from the lever body 30, the wire harness 73 is pulled. Accordingly, the middle portion of the wire harness 73 stored in the harness storage portion 52 is sequentially paid out from the path 53 of the harness storage portion 52 to the wiring groove 54 of the arm 35.

Figure 13:
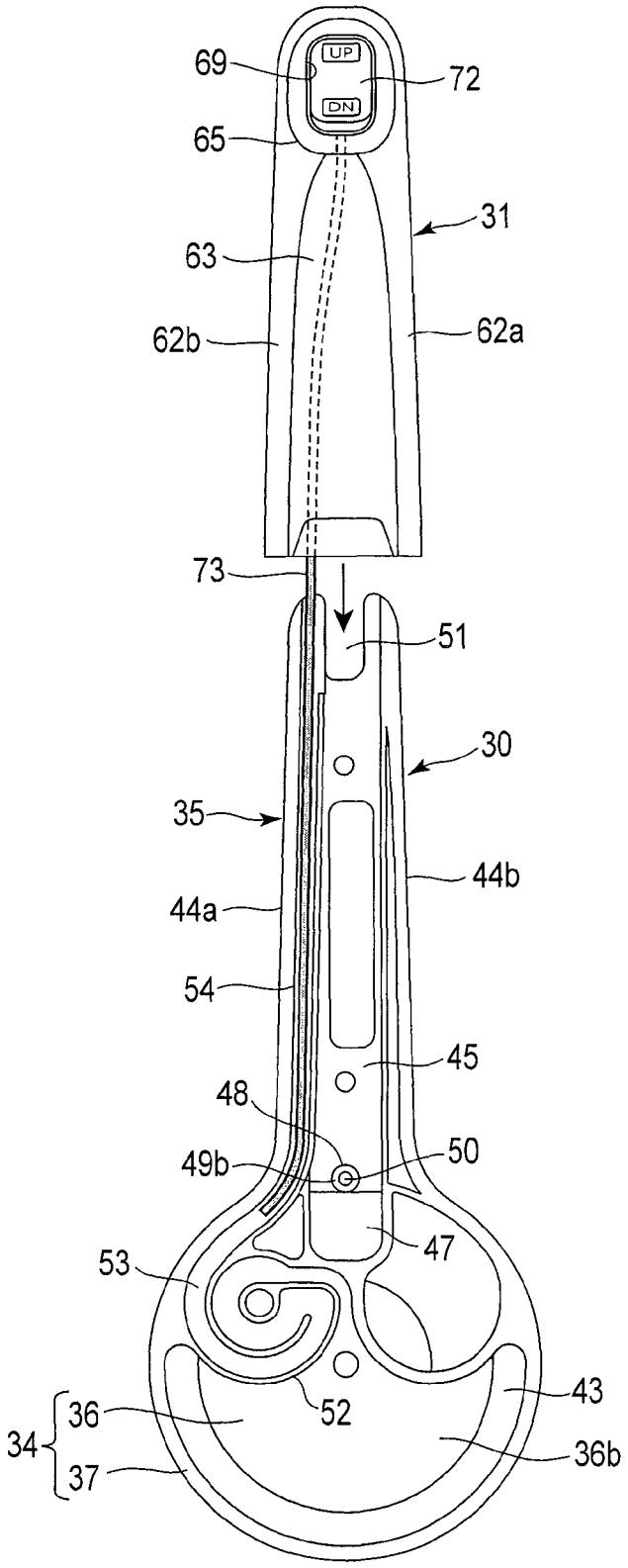
FIG. 13 is a front view of the control lever where the grip is laterally inverted and attached to the arm of the lever body.
Figure 14:
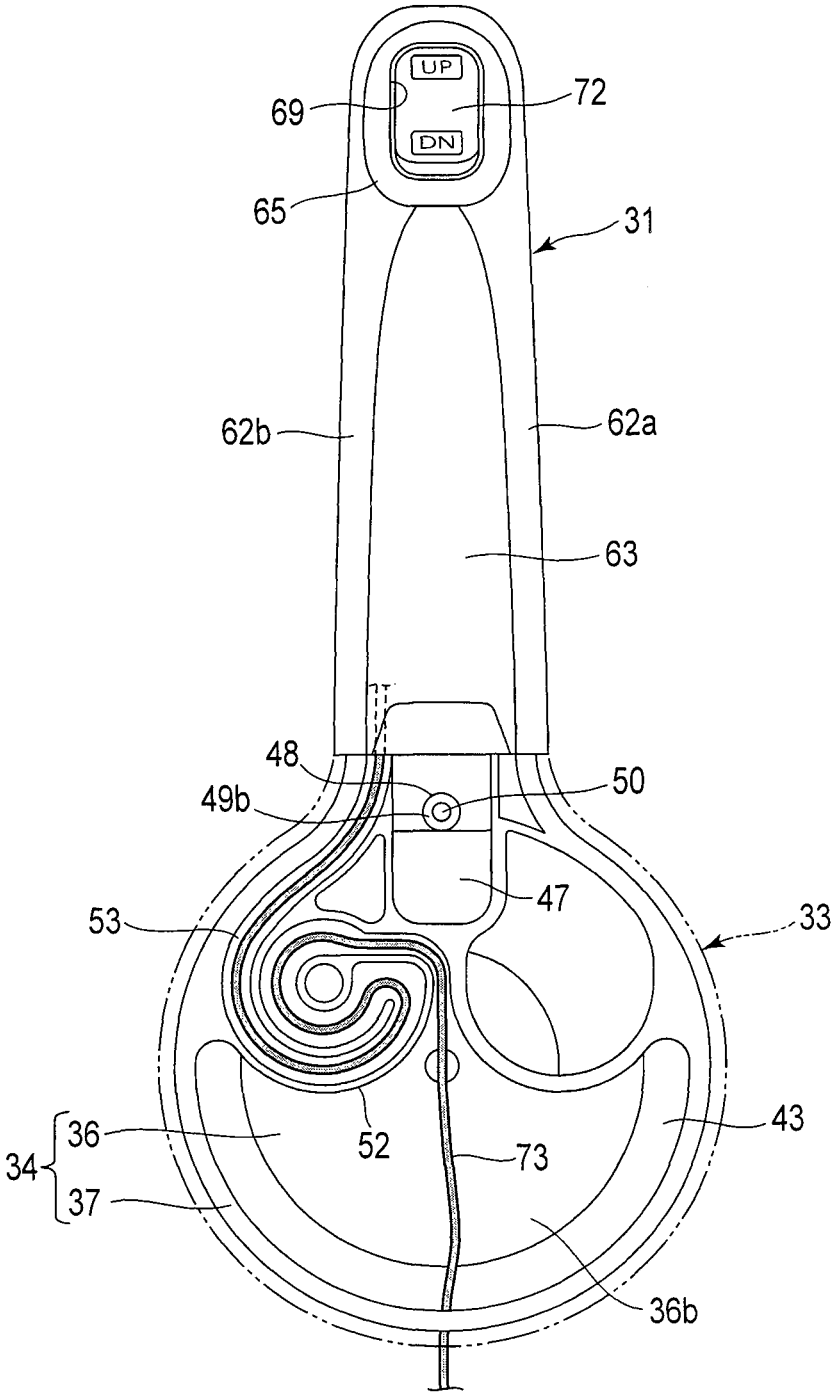
FIG. 14 is a front view of the control lever where the grip is attached to the arm of the lever body.

Following this, the grip 31 is laterally inverted and then the inverted grip 31 is fitted into the arm 35 of the lever body 30 as shown by the arrow in FIG. 13. During the fitting, it should be noted that the wire harness 73 extended from the tilt switch 71 is not caught between the grip body 60 and the arm 35. Furthermore, as shown in FIG. 14, the wire harness 73 is guided above the second surface 36*b* of the supporting wall 36 from the wiring groove 54 through the path 53 of the harness storage portion 52, and pulled to the outside of the control lever 12 from the harness through-hole 43.

Then, the grip 31 is supported on the lever body 30 by means of the screw 68. Subsequently, the slide 80 of the lock lever 32 is fitted into the first groove 46*a* of the arm 35, and the lock lever 32 is slidably supported on the first groove 46*a* by means of the screw 86 and the flat washer 87. In this manner, the gripping portion 81 of the lock lever 32 is fitted inside the handle 61 of the grip 31, and the first corner 88*a* of the engagement portion 82 of the lock lever 32 is positioned at the end of the first groove 46*a*, as shown in FIG. 16.

Finally, the cover 33 is attached to the base 34 of the lever body 30, and the harness storage portion 52 and the middle portion of the wire harness 73 are covered by the sidewall portion 91 of the cover 33. The assembly of the control lever 12 is thereby completed.

Figure 15:
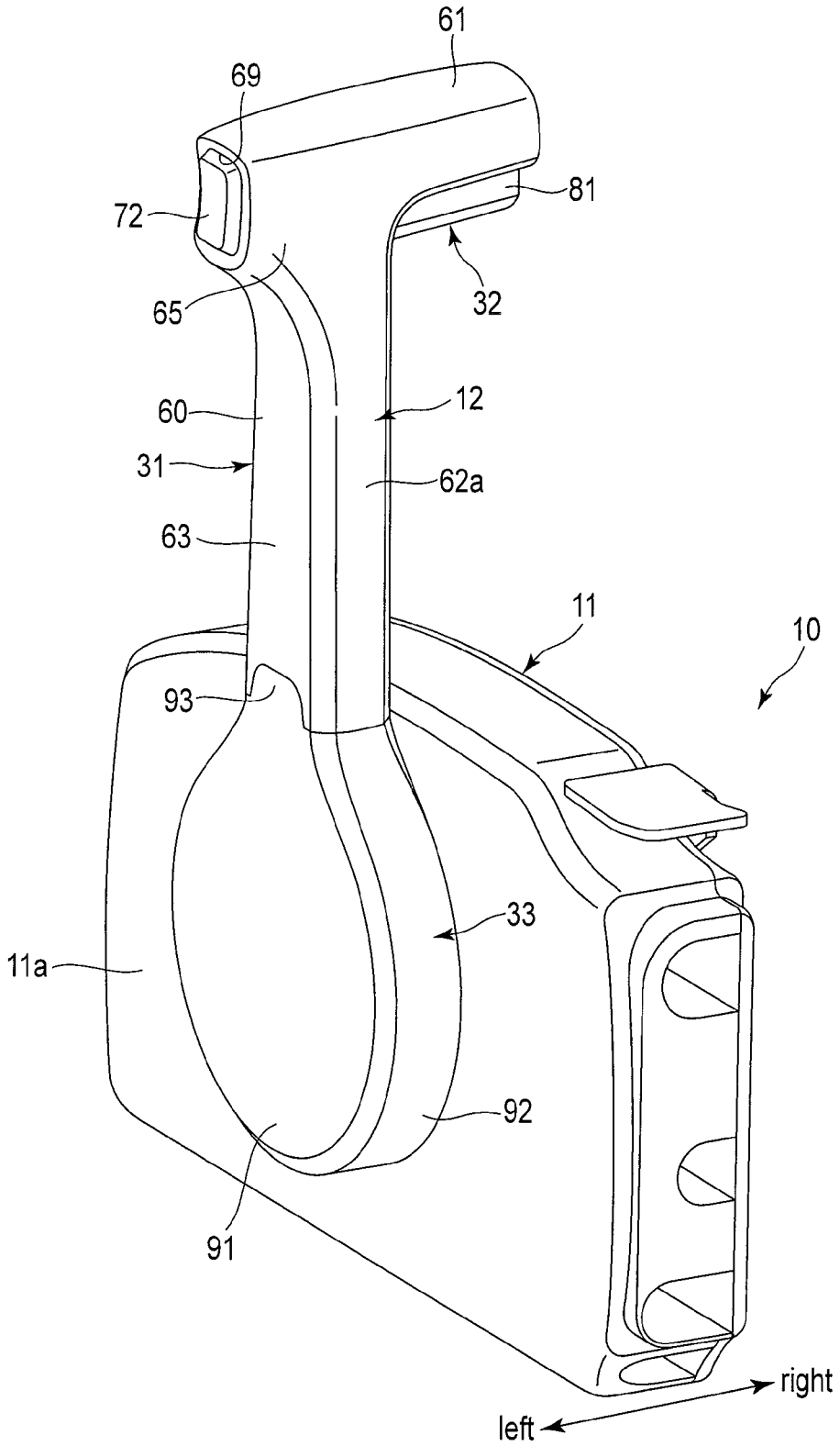
FIG. 15 is a perspective view of the remote-control device where the control lever is attached to a left side surface of the control box.

Next, the fitting protrusion 40 of the control lever 12 is fitted into the fitting hole 24*a* of the rotatable member 18 exposed on the left side surface 11*a* of the control box 11. In FIG. 15 and FIG. 16, the control lever 12 is attached to the left side surface 11*a* of the control box 11. As is obvious from FIG. 15 and FIG. 16, the grip 31 is fixed to the arm 35 of the lever body 30 in the same orientation as the orientation shown in FIG. 3. In addition, the lock lever 32, which is detached from the second groove 46*b* of the lever body 30 and attached to the first groove 46*a*, is supported on the arm 35 in the same orientation as the orientation shown in FIG. 3.

Thus, if the control lever 12 is attached to the left side, surface 11*a* of the control box 11, the orientation of the handle 61 of the grip 31 is the same as the orientation in the case where the control lever 12 is attached to the right side surface 11*b* of the control box 11. Therefore, the control button 72 of the tilt switch 71 is positioned at the left end of the handle 61.

Furthermore, as shown in FIG. 16, if the lock lever 32 is slid to the lock position in the case where the control lever 12 is attached to the left side surface 11*a* of the control box 11, the first corner 88*a* of the engagement portion 82 is fitted into the recess 16 of the neutral lock holder 15. By the fitting, the control lever 12 is locked in the neutral position. If the lock lever 32 is slid from the lock position to the unlock position, the first corner 88*a* of the engagement portion 82 is displaced from the recess 16 of the neutral lock holder 15. Consequently, the control lever 12 is unlocked and the control lever 12 can be moved to the first control position or the second control position.

According to the embodiment, the tilt switch 71 can be constantly positioned at the left end of the handle 61 of the grip 31 even if the control lever 12 is detached from the right side surface 11*b* of the control box 11 and attached to the left side surface 11*a*, or detached from the left side surface 11*a* and attached to the right side surface 11*b*.

As a result, the operator can control the control button 72 of the tilt switch 71 with the right thumb. Therefore, operability of the tilt switch 71 is preferable even if the control lever 12 is laterally inverted.

In addition, according to the embodiment, the middle portion of the wire harness 73 is stored in the harness storage portion 52 in the serpentine-curved form so as to be paid out. Therefore, if the grip 31 is extracted from the arm 35 of the lever body 30, the wire harness 73 is paid out from the harness storage portion 52 to the wiring groove 54 following the extraction.

Thus, the length of the wire harness 73 can be sufficiently secured inside the control lever 12. Accordingly, whenever the grip 31 equipped with the tilt switch 71 is laterally inverted with respect to the arm 35 of the lever body 30, it is unnecessary to detach the tilt switch 71 from the grip 31 or change the wiring path of the wire harness 73. Therefore, the grip 31 can be laterally inverted while the tilt switch 71, from which the wire harness 73 is extended, is attached to the grip 31, which improves workability during the inversion of the grip 31.

Moreover, in the embodiment, the wiring groove 54 of the lever body 30 is provided in the position displaced from the first groove 46*a* and second groove 46*b* into which the lock lever 32 is slidably fitted. Therefore, when the lock lever 32 is detached from the first groove 46*a* and attached to the second groove 46*b* or detached from the second groove 46*b* and attached to the first groove 46*a*, the wire harness 73 passing through the wiring groove 54 is not obstructive and the inversion of the lock lever 32 can be easily carried out. In addition, the wire harness 73 is not caught between the lock lever 32 and the arm 35, and damage to the wire harness 73 can be avoided.

For example, the cable storage portion is not limited to the structure of having a serpentine-curved path, but may be a chamber defined by partitions and the wire harness may be roughly stored in the chamber.

The arm of the lever body does not necessarily have an H-shaped cross section. For example, the arm may have a ladder form obtained by connecting a pair of opposite walls to each other by a plurality of crossbars, or have a T-shaped cross section obtained by omitting one of the opposite walls.

The lock lever may be omitted from the control lever.

The remote-control device is not limited to an element for controlling a boat propulsion unit such as an outboard motor, but may be utilized as an element for, for example, controlling a crane of a wrecker or a crane of construction equipment.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A control lever attached to any one of a right side surface and a left side surface of a control box so as to be selectively detachable, and manually turned in a back and forth direction of the control box, the control lever comprising:

a lever body comprising a base connected to a rotatable member in the control box, and an arm extended straight from an outer periphery of the base, the arm comprising a first portion and a second portion positioned at a back of the first portion, the first portion and the second portion being arranged in a lateral direction of the arm and having shapes that are symmetrical to each other;

a grip arranged on the arm so as to be extractable in a longitudinal direction of the arm to selectively cover any one of the first portion and the second portion from a right side or a left side of the arm, the grip comprising a handle positioned on an opposite side of the base; and a switch provided at an end of the handle, the switch comprising a button which is manually controllable and a cable paid out from the switch, the cable being guided to the base through a space between the arm and the grip, and further guided to the control box from the base, wherein the base comprises a storage portion having a serpentine-curved path, and a middle portion of the cable passes through the path such that the cable can be paid out therefrom.

2. The control lever of claim 1, wherein the cable has a length at least two times as long as a whole length of the arm.

3. The control lever of claim 1, further comprising a lock lever configured to lock the lever body in a neutral position, the lock lever being attached to the first portion or the second portion of the arm so as to be selectively detachable.

4. The control lever of claim 3, wherein the arm of the lever body comprises:

a pair of opposite walls facing each other with an interval; and a connecting wall extended between the opposite walls; wherein:

the first portion of the arm is a first groove defined by a first surface of the connecting wall and inner surfaces of the opposite walls;

the second portion of the arm is a groove defined by a second surface of the connecting wall and the inner surfaces of the opposite walls, and the grip is attached to the arm so as to cover any one of the first portion and the second portion and to be extractable in the longitudinal direction of the arm, and the detachable lock lever is fitted to the other of the first portion and the second portion.

5. The control lever of claim 4, wherein:

the arm comprises a wiring groove through which the cable passes, the wiring groove is extended along the longitudinal direction of the arm in a position displaced from the first portion of the arm and the second portion of the arm, a first end of the wiring groove is opened at a distal end of the arm, and a second end of the wiring groove is continuously connected to the storage portion.

6. The control lever of claim 4, wherein the grip comprises:

a pair of external walls which covers the opposite walls of the arm; and a sidewall which extends between the external walls and covers the first portion of the arm or the second portion of the arm, wherein guide grooves to which the opposite walls are slidably fitted are provided on inner surfaces of the external walls.

7. The control lever of claim 4, wherein the lock lever comprises:

a gripping portion which protrudes below from the handle of the grip;

a first corner positioned at an opposite end of the gripping portion, the first corner being locked in a lock holder attached to the control box when the lock lever is fitted into the first portion of the arm; and a second corner positioned at the opposite end of the gripping portion, the second corner penetrating the base and being locked in the lock holder when the lock lever is fitted into the second portion of the arm.

8. The control lever of claim 1, further comprising a cover which is attached to the base of the lever body so as to be detachable and covers the storage portion.

9. A remote-control device comprising:

a control box comprising a right side surface and a left side surface; and a control lever attached to any one of the right side surface and the left side surface of the control box so as to be selectively detachable, and manually turnable in a back and forth direction of the control box, the control lever comprising:

a lever body comprising a base connected to a rotatable member in the control box, and an arm extended straight from an outer periphery of the base, the arm comprising a first portion and a second portion positioned at a back of the first portion, the first portion and the second portion being arranged in a lateral direction of the arm and having shapes that are symmetrical to each other;

a grip arranged on the arm of the lever body so as to be extractable in a longitudinal direction of the arm to selectively cover the first portion or the second portion of the arm from a right side or a left side of the arm, the grip comprising a handle positioned on an opposite side of the base;

a switch provided at an end of the handle, the switch comprising a button which is manually controllable and a cable paid out from the switch, the cable being guided to the base through a space between the arm and the grip, and further guided to the control box from the base, wherein the base comprises a storage portion having a serpentine-curved path, and a middle portion of the cable passes through the path such that the cable can be paid out therefrom.

10. The remote-control device of claim 9, wherein the control lever further comprises a lock lever which locks the lever body in a neutral position, and the lock lever is attached to the first portion or the second portion of the arm so as to be selectively detachable.

* * * * *